US005876271A

United States Patent [19]

Oliver

[11] Patent Number: 5,876,271

[45] Date of Patent: Mar. 2, 1999

[54] SLURRY INJECTION AND RECOVERY METHOD AND APPARATUS FOR CHEMICAL-MECHANICAL POLISHING PROCESS

[75] Inventor: Michael R. Oliver, Christiana, Del.

[73] Assignee: Intel Corporation, Santa Clara, Calif.

[21] Appl. No.: 579,474

[22] Filed: Dec. 27, 1995

Related U.S. Application Data

[63] Continuation-in-part of Ser. No. 103,412, Aug. 6, 1993, Pat. No. 5,554,064.

[51] Int. Cl.[6] ..... B24B 19/22; B24B 57/02

[52] U.S. Cl. ..... 451/60; 451/41; 451/446

[58] Field of Search ..... 451/41, 60, 446, 451/287, 288, 921, 56, 530, 527

[56] References Cited

U.S. PATENT DOCUMENTS

| | | | |
|---|---|---|---|
| 4,831,784 | 5/1989 | Takahashi | 51/131.1 |
| 5,185,966 | 2/1993 | Mock, Jr. et al. | 51/283 |
| 5,216,843 | 6/1993 | Breivogel et al. | 51/131.1 |
| 5,230,184 | 7/1993 | Bukhman | 51/283 |
| 5,232,875 | 8/1993 | Tuttle et al. | 437/225 |
| 5,351,445 | 10/1994 | Takahashi | 451/271 |
| 5,584,749 | 12/1996 | Mitsuhashi et al. | 451/41 |

FOREIGN PATENT DOCUMENTS

| | | | |
|---|---|---|---|
| 1135745 | 5/1989 | Japan | 451/287 |
| 1321161 | 12/1989 | Japan | 451/446 |
| 2100321 | 4/1990 | Japan . | |
| 0643298 | 1/1979 | U.S.S.R. | 451/446 |
| 878533 | 11/1981 | U.S.S.R. . | |
| 1027017 | 7/1983 | U.S.S.R. . | |

*Primary Examiner*—Robert A. Rose

*Attorney, Agent, or Firm*—Blakely, Sokoloff, Taylor & Zafman LLP

[57] ABSTRACT

A method and apparatus for polishing a thin film formed on a semiconductor substrate. A table covered with a polishing pad is orbited about an axis. Slurry is delivered through a plurality of spaced-apart holes formed through the polishing pad to uniformly distribute slurry across the pad surface during polishing. Slurry extraction holes are interspersed between the slurry delivery holes to facilitate the removal of slurry from the polishing pad surface. A substrate is pressed face down against the orbiting pad's surface and rotated to facilitate, along with the slurry, the polishing of the thin film formed on the substrate.

19 Claims, 18 Drawing Sheets

SLURRY INJECTION AND RECOVERY METHOD AND APPARATUS FOR CHEMICAL-MECHANICAL POLISHING PROCESS

BACKGROUND OF THE INVENTION

This is a continuation-in-part of Ser. No. 08/103,412, filed Aug. 6, 1993, now U.S. Pat. No. 5,554,064, which application is assigned to the assignee of the present invention.

BACKGROUND OF THE INVENTION

1. Field of the Invention

The present invention relates to the field of semiconductor manufacturing, and more specifically to the field of chemical-mechanical polishing methods and apparatuses for the planarization and removal of thin films used in semiconductor manufacturing.

2. Description of Relevant Art

Integrated circuits manufactured today are made up of literally millions of active devices such as transistors and capacitors formed in a semiconductor substrate. Integrated circuits rely upon an elaborate system of metalization in order to connect the active devices into functional circuits. A typical multilevel interconnect 100 is shown in FIG. 1. Active devices such as MOS transistors 107 are formed in and on a silicon substrate or well 102. An interlayer dielectric (ILD) 104, such as $SiO_2$, is formed over silicon substrate 102. ILD 104 is used to electrically isolate a first level of metalization which is typically aluminum from the active devices formed in substrate 102. Metalized contacts 106 electrically couple active devices formed in substrate 102 to the interconnections 108 of the first level of metalization. In a similar manner metal vias 112 electrically couple interconnections 114 of a second level of metalization to interconnections 108 of the first level of metalization. Contacts and vias 106 and 112 typically comprise a metal 116 such as tungsten (W) surrounded by a barrier metal 118 such as titanium-nitride (TiN). Additional ILD/contact and metalization layers can be stacked one upon the other to achieve the desired interconnection.

A considerable amount of effort in the manufacturing of modern complex, high density multilevel interconnections is devoted to the planarization of the individual layers of the interconnect structure. Nonplanar surfaces create poor optical resolution of subsequent photolithographic processing steps. Poor optical resolution prohibits the printing of high density lines. Another problem with nonplanar surface topography is the step coverage of subsequent metalization layers. If a step height is too large there is a serious danger that open circuits will be created. Planar interconnect surface layers are a must in the fabrication of modern high density integrated circuits.

To ensure planar topography, various planarization techniques have been developed. One approach, known as chemical-mechanical polishing, employs polishing to remove protruding steps formed along the upper surface of ILDs. Chemical-mechanical polishing is also used to "etch back" conformally deposited metal layers to form planar plugs or vias. In a typical chemical-mechanical polishing method, as shown in FIGS. 2*a* and 2*b*, a silicon substrate or wafer 202 is placed face down on a rotating table 204 covered with a flat pad 206 which has been coated 208 with an active slurry. A carrier 210 is used to apply a downward force $F_1$ against the backside of substrate 202. The downward force $F_1$ and the rotational movement of pad 206 together with the slurry facilitate the abrasive polishing or planar removal of the upper surface of the thin film. Carrier 210 is also typically rotated to enhance polishing uniformity.

There are several disadvantages associated with present techniques of chemical-mechanical polishing. One significant problem is the different pad environments seen by different radii of the wafer being polished. This problem is due to the rotational movement of pad 206. As is apparent in FIG. 2*b*, the radius of pad 206 is significantly larger than the radius of wafer 202. During polishing, polishing pad 206 becomes worn, and a polishing track 210 develops in polishing pad 206. Inner track 210*b* of polishing pad 206 wears out faster that outer track 210*a* of polishing pad 206 because there is less pad material along inner track 210*b* than outer track 210*a*. The uneven pad wear results in a degradation of polishing uniformity across a wafer and from wafer to wafer.

Another problem associated with present chemical-mechanical polishing techniques is the slurry delivery process. As shown in FIGS. 2*a* and 2*b*, slurry is simply dumped from a nozzle 208 onto pad 206. Slurry then rotates around on pad 206 and attempts to pass under the wafer 202 being polished. Unfortunately, however, slurry builds up on the outside of wafer 202 and creates a "squeegee effect" which results in poor slurry delivery to the center of the wafer. Such a nonuniform and random slurry delivery process creates a nonuniform polishing rate across a wafer and from wafer to wafer. It is to be appreciated that the polishing rate is proportional to the amount of slurry beneath the wafer during polishing.

Another problem with present slurry delivery systems is the long time it takes for slurry to reach wafer 206, pass beneath it, and finally polish. Such a long transition time prohibits a manufacturably reliable switching from one slurry to another, as may be desired in the case of polishing back a barrier metal after the polishing of a via filling metal. Additionally, some slurries degrade when exposed to air for extended periods of time. The polishing qualities of these slurries can degrade in present slurry delivery systems.

Additionally, present slurry deliver systems waste much of the slurrry that is used in the polishing process. This results in higher manufacturing costs. Excesssive slurry waste is especially problematic when expensive slurries, such as ceria slurries, are used. Each of these characteristics makes present slurry deliver techniques manufacturably unacceptable.

Thus, what is needed is a method of polishing thin films formed on a semiconductor substrate or wafer wherein polishing pad movement and slurry delivery are more uniform across the surface of a wafer so that thin films formed on the wafer surface exhibit a more uniform polish rate across the wafer and from wafer to wafer.

SUMMARY OF THE INVENTION

A novel chemical-mechanical polishing technique with an extremely uniform polish rate is described. A polishing pad is orbited about an axis. The radius of orbit of the polishing pad is less than the radius of the wafer to be polished. In one embodiment polishing slurry is fed through a plurality of uniformly spaced holes formed through the polishing pad. A plurality of preformed grooves which communicate to the holes are formed in the upper surface of the polishing pad in order to facilitate uniform slurry delivery. A wafer to be polished is placed face down and forcibly pressed against the orbiting pad surface. The center of the wafer is slightly offset from the axis of orbit of the pad to prevent a pattern from developing during polishing. The wafer is rotated about its center to help facilitate polishing and to help prevent patterning.

In another embodiment polishing slurry is fed through and removed from the surface of the polishing pad through a plurality of holes formed through the polishing pad. The surface of the polishing pad may be texturized to facilitate the transport of slurry between the slurry injection and extraction holes.

DETAILED DESCRIPTION OF THE PRESENT INVENTION

An improved polishing apparatus and method utilized in the polishing of thin films formed on a semiconductor substrate is described. In the following description numerous specific details are set forth, such as specific equipment and materials etc., in order to provide a thorough understanding of the present invention. It will be obvious, however, to one skilled in the art that the present invention may be practiced without these specific details. In other instances, well-known machines and process steps have not been described in particular detail in order to avoid unnecessarily obscuring the present invention.

Figure 1:
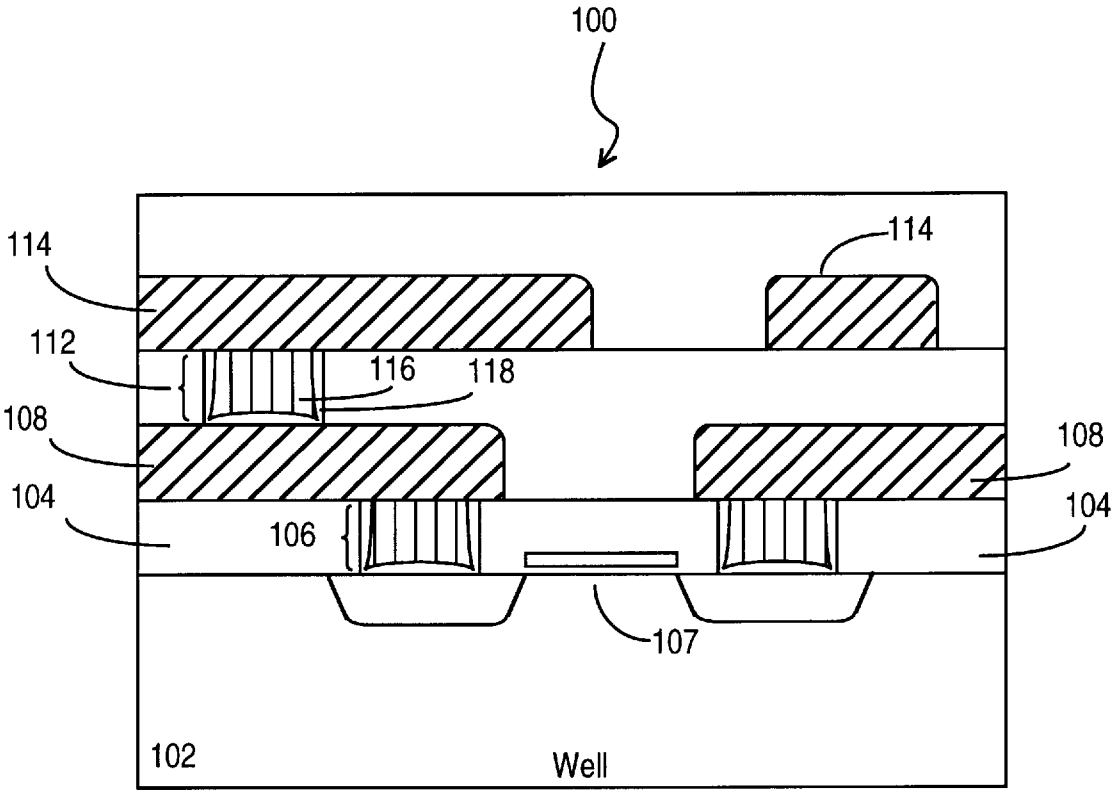
FIG. 1 is a cross-sectional illustration of a standard multilayer interconnect structure used in semiconductor integrated circuits.
Figure 2A:
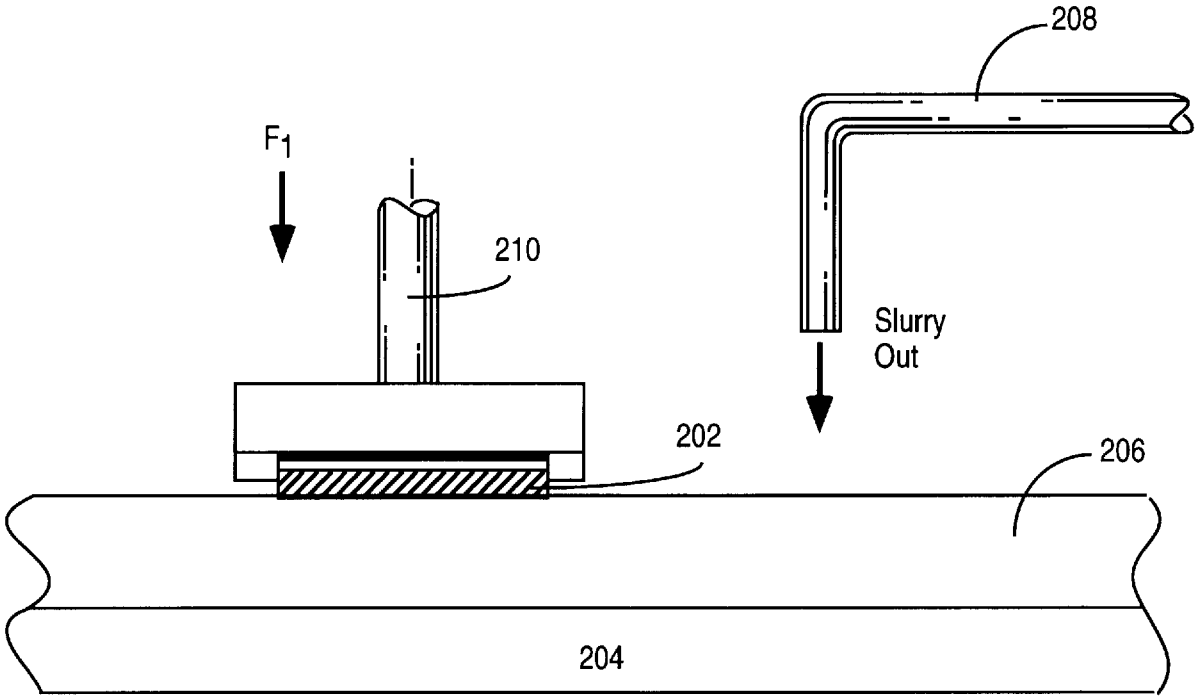
FIG. 2*a* is a cross-sectional view of an illustration of an earlier chemical-mechanical polishing technique.
Figure 2B:
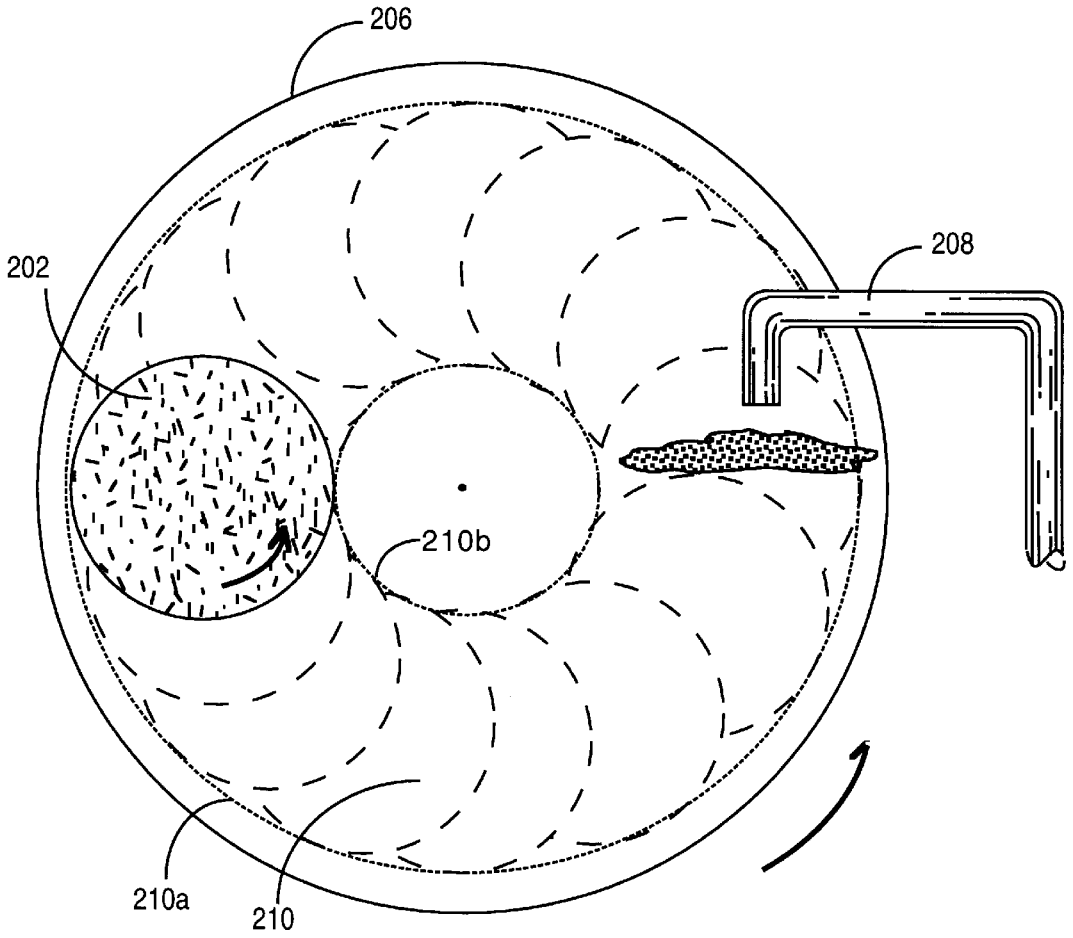
FIG. 2*b* is an overhead view of an illustration of an earlier chemical-mechanical polishing technique.
Figure 3A:
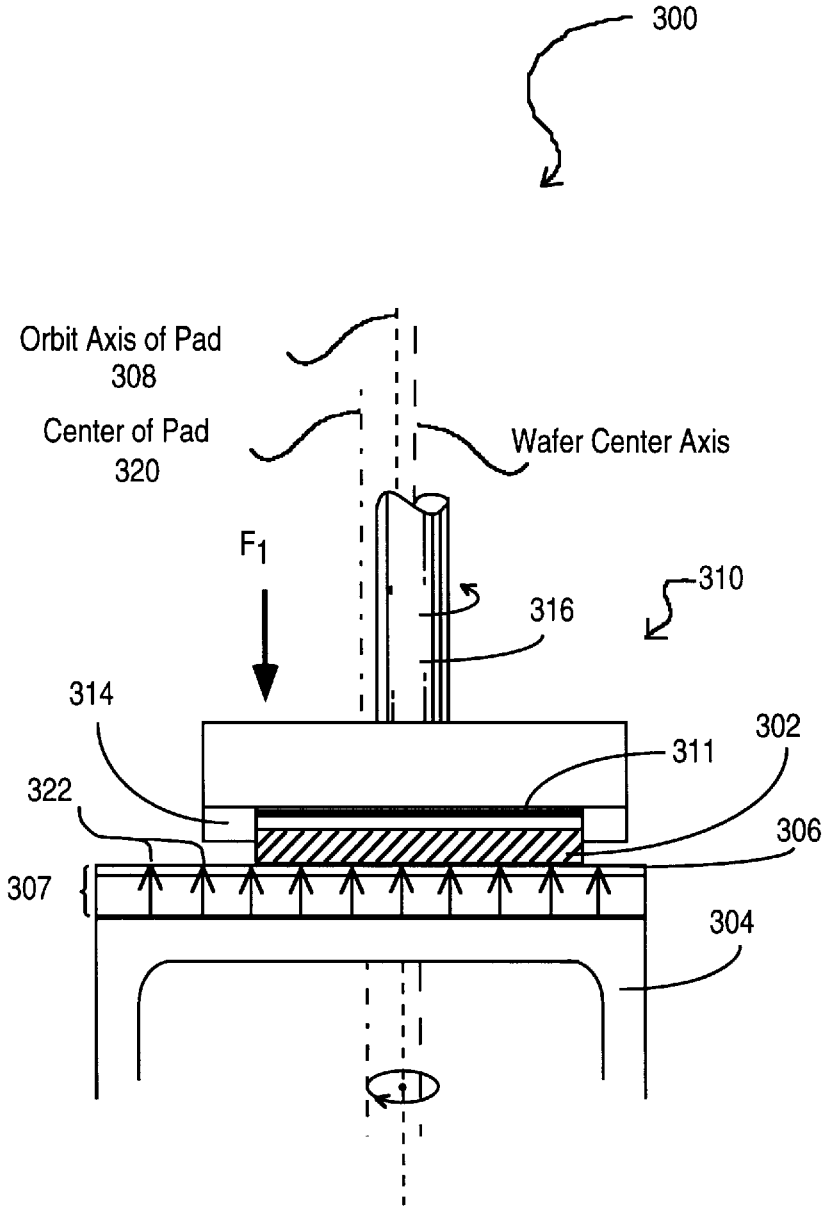
FIG. 3*a* is a cross-sectional view of an illustration of the chemical-mechanical polishing apparatus of the present invention.
Figure 3B:
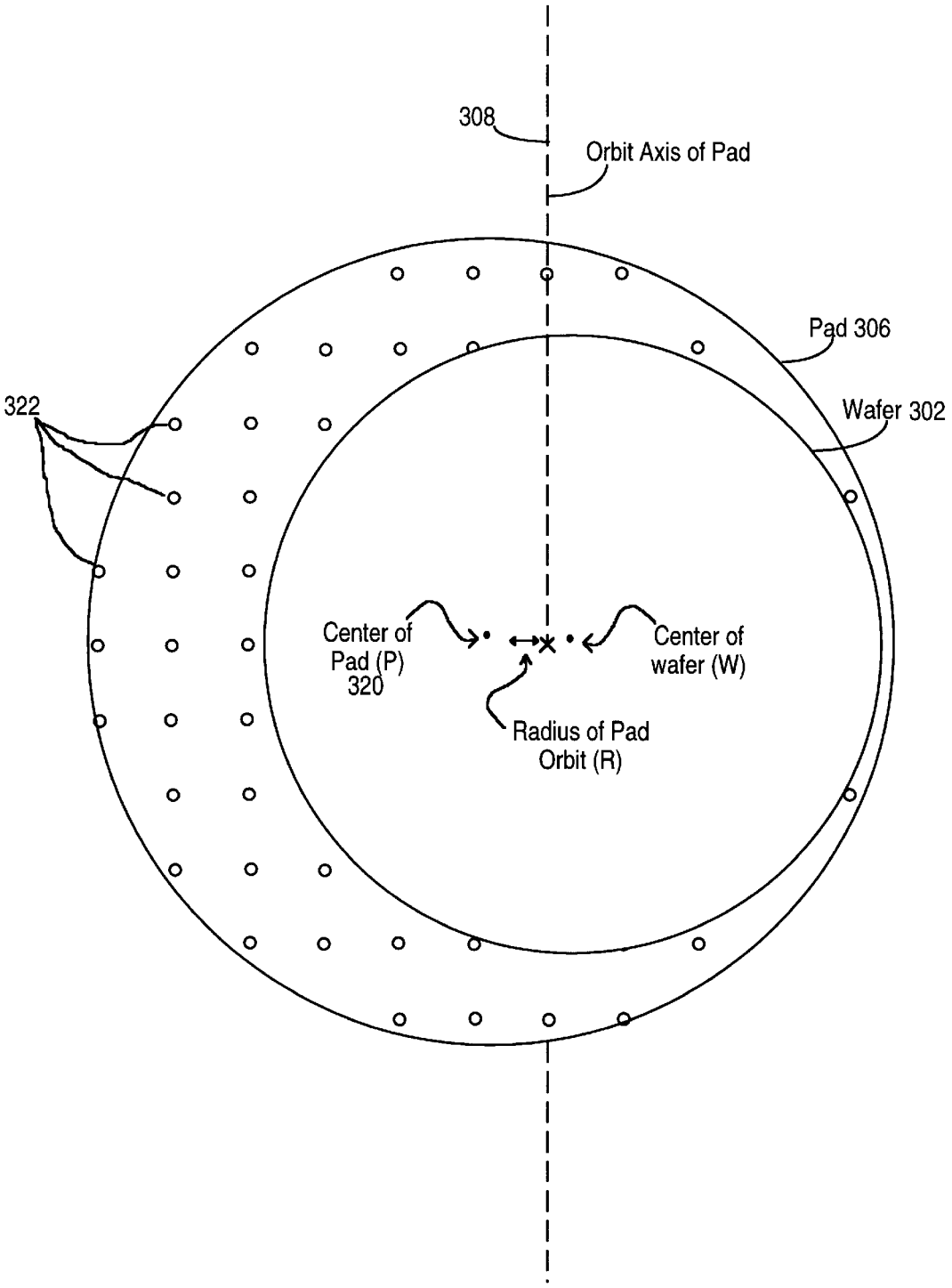
FIG. 3*b* is an overhead view of an illustration of the chemical-mechanical polishing apparatus of the present invention.

FIGS. 3*a* and 3*b* represent a cross-sectional and overhead illustration, respectively, of the polishing apparatus 300 of one embodiment of the present invention. The polishing apparatus 300 is used to planarize a thin film layer formed over a semiconductor substrate. In a typical use, the thin film is an interlayer dielectric (ILD) formed over and between two metal layers of a semiconductor device. In another use, the thin film is a metal such as tungsten which has been conformally deposited onto an ILD and into via openings, and which is then polished back to form planar plugs or vias. The thin film, however, need not necessarily be an ILD or a metal for a plug, but can be any one of a number of thin films used in semiconductor integrated circuit manufacturing such as, but not limited to, metal layers, organic layers, and even the semiconductor material itself. In fact, the chemical-mechanical polishing technique of the present invention can be generally applied to any polishing process which uses similar equipment and where nonuniform slurry delivery or pad movement across a wafer causes a nonuniform polish rate. For example, the present invention may be useful in the manufacture of metal blocks, plastics, and glass plates etc.

In accordance with the present invention a semiconductor substrate or wafer 302 is placed face down on a pad 306 of pad assembly 307 which is fixedly attached to the upper surface of a table 304. In this manner the thin film to be polished is placed in direct contact with the upper surface of pad 306. In the present invention, the center 320 of table 304 and pad 306 orbits clockwise about a fixed point 308. The radius (R) of the orbit is less than the radius of the wafer to be polished. In the present invention polish pad 306 is only slightly larger than wafer 302. The center 318 of wafer 302 is offset from the center 320 of pad 306 and from the axis of orbit 308. Slurry is delivered to the wafer/pad interface by feeding slurry through a plurality of equally spaced holes 322 formed throughout polish pad 306. The polishing process is facilitated by uniformly distributing slurry at the wafer/pad interface while pad 306 orbits about a fixed point 308 and wafer 302 rotates counter clockwise about its center (W) with a downward force. Polishing is continued in this manner until the desired planarity or film removal has been achieved.

A carrier 310 can be used to apply a downward pressure $F_1$ to the backside of wafer 302. The backside of wafer 302 can be held in contact with the bottom of carrier 310 by a vacuum or simply by wet surface tension. Preferably an insert pad 311 cushions wafer 302 from carrier 310. An ordinary retaining ring 314 can be employed to prevent wafer 302 from slipping laterally from beneath carrier 310 during processing. The pressure $F_1$ is applied by means of a shaft 316 attached to the back of carrier 310. The pressure is used to facilitate the abrasive polishing of the upper surface of the thin film. The greater the polish pressure, the greater the polish rate and wafer throughput. Planarity, however, is reduced with high polish pressures. An applied pressure $F_1$ of between 4–6 lbs/in$^2$ has been found to provide good results. Shaft 316 rotates to impart rotational movement to substrate 302. Shaft 316 can be rotated by the use of well-known means such as a belt and a variable speed motor. It is to be appreciated that other carriers such as the improved carriers described in copending application Ser. No. 08/103,918, filed Aug. 6, 1993, and assigned to the present assignee, can also be utilized in the present invention.

Pad 306 can be made up of a variety of materials. For example, in the planarization of an oxide based interlayer dielectric, the pad comprises a relatively hard polyurethane or similar material. An alternative pad material, such as a urethane impregnated felt pad may be used in the polishing of a metal, such as tungsten, in the etchback step of a plug formation process. Pad 306 can be grooved to facilitate slurry delivery. Additionally, a wide variety of well-known slurries can be used for polishing. The actual composition of the slurry depends upon the type of material to be polished. Silica-base slurry solutions are typiically used in the polishing of oxides. For example, a slurry known as SS25 which is manufactured by Cabot Incorporated, can be utilized to polish oxide based ILDs. Alumina-base solutions are generally used in the polishing of metals.

Figure 4A:
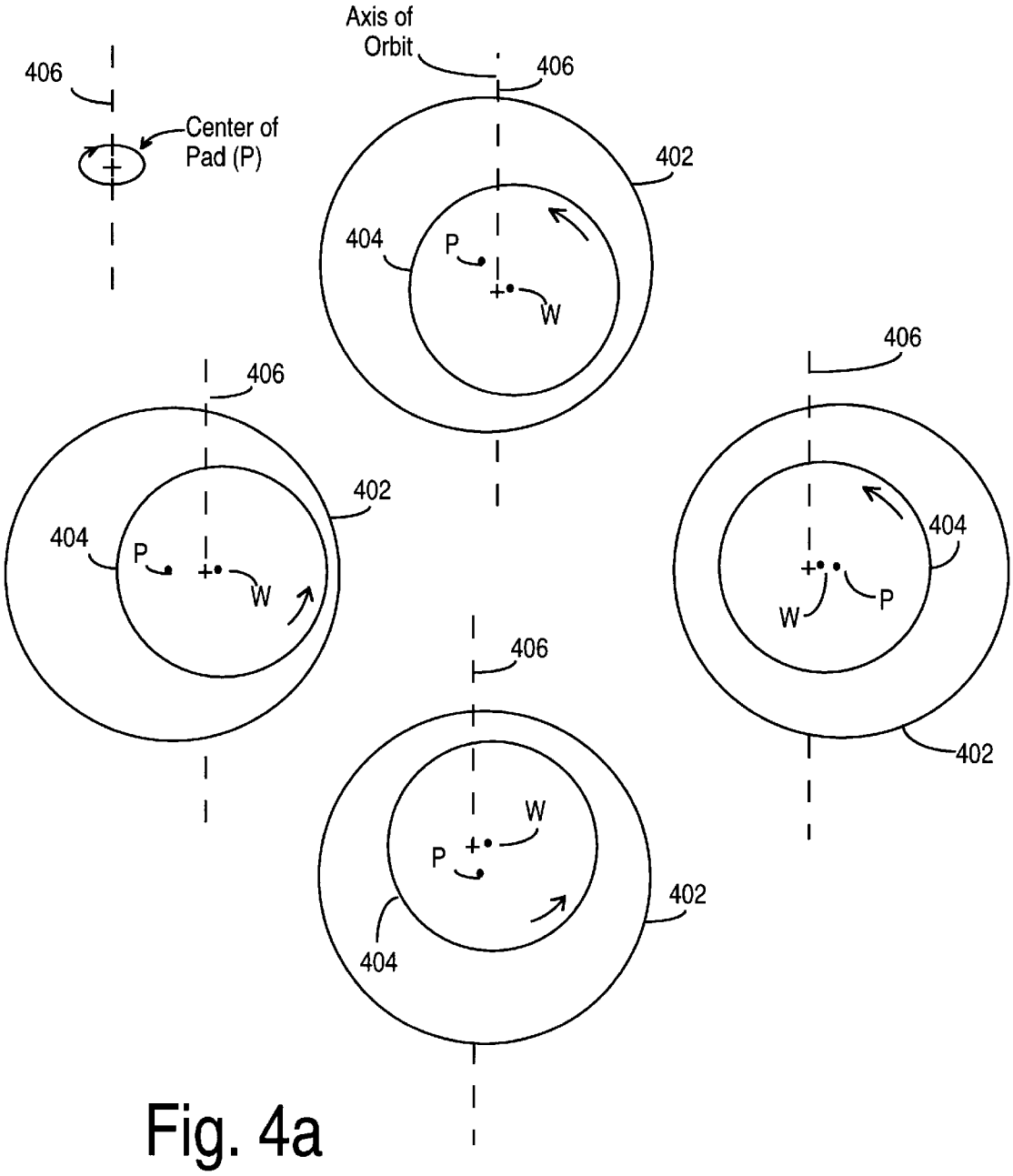
FIG. 4*a* is an overhead view illustrating the orbital movement of the pad relative to the wafer in the chemical-mechanical polishing technique of the present invention.
Figure 4B:
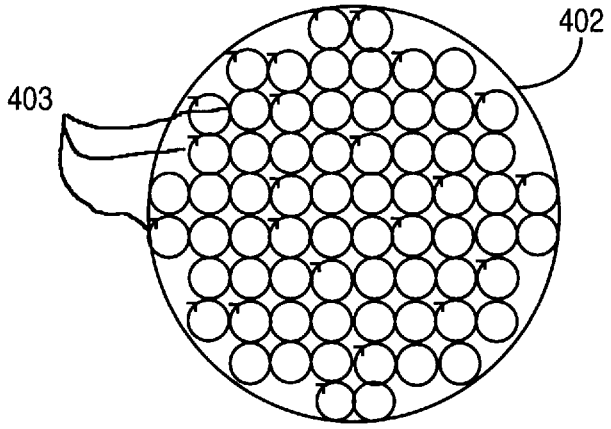
FIG. 4*b* is an illustration of the "orbital effect" of the chemical-mechanical planarization process of the present invention.

An important feature of the present invention is the fact that pad 306 orbits as opposed to rotates during polishing. The orbital movement of pad 306 with respect to wafer 302 is illustrated in FIG. 4*a*. The center (P) of pad 402 is shown orbiting under wafer 404 about an axis 406. The effect of the orbital motion of pad 404 can be generalized or illustrated as shown in FIG. 4*b*. The orbital motion of pad 402 creates a uniform movement across the surface of pad 402. Each point on pad 402 makes a complete circle 403 during each orbit of pad 402. The radius of the circle 403 is equal to the radius of the orbit of pad 402. In this way the local polishing environments seen by the surface of wafer 404 are substantially the same. In the present invention pad velocity is completely uniform across the wafer's surface. The uniform pad movement created by the orbital movement of polishing pad 402 creates a uniform polish rate across the surface of a wafer. It is to be noted, that alternatively wafer 404 can be made to orbit about a fixed axis while polishing pad 402 is rotated and still obtain the benefits of orbital polishing.

It is to be appreciated that the radius of orbit of the polishing pad should be less than the radius of the wafer being polished, and preferably substantially less. This ensures that the surface of the wafer sees substantially the same orbital motion to achieve good regional and global planarization. It will be recognized by one skilled in the art that the minimum polishing pad size is dependent upon the size of the wafer being polished and the orbit radius of the motion of the polishing pad. It has been found that for polishing an eight inch diameter wafers, a ten inch diameter polishing pad having an approximately 0.75 inch orbit radius provides good polish uniformity. Additionally, the orbit rate of the polishing pad is chosen to optimize the balance between wafer throughput and polish uniformity. It has been found that an orbit rate of between 140–220 orbits/min provides good polish uniformity and wafer throughput.

Additionally, in the present invention, as shown in FIG. 4*a*, wafer 404 can be rotated about its center (W) by carrier 310 during polishing. The rotation of wafer 404 helps facilitate polishing and helps to average out any grooves or patterns which may develop during polishing. Rotating wafer 404 at a rate of between 5–15 rpms has been found to provide good results. Additionally, the center W of wafer 404 is offset from the axis of orbit 406 of pad 404 and the physical center (P) of pad 404. This positioning or alignment greatly enhances the smearing effect of the planarization process and helps guarantee polish uniformity.

Figure 5:
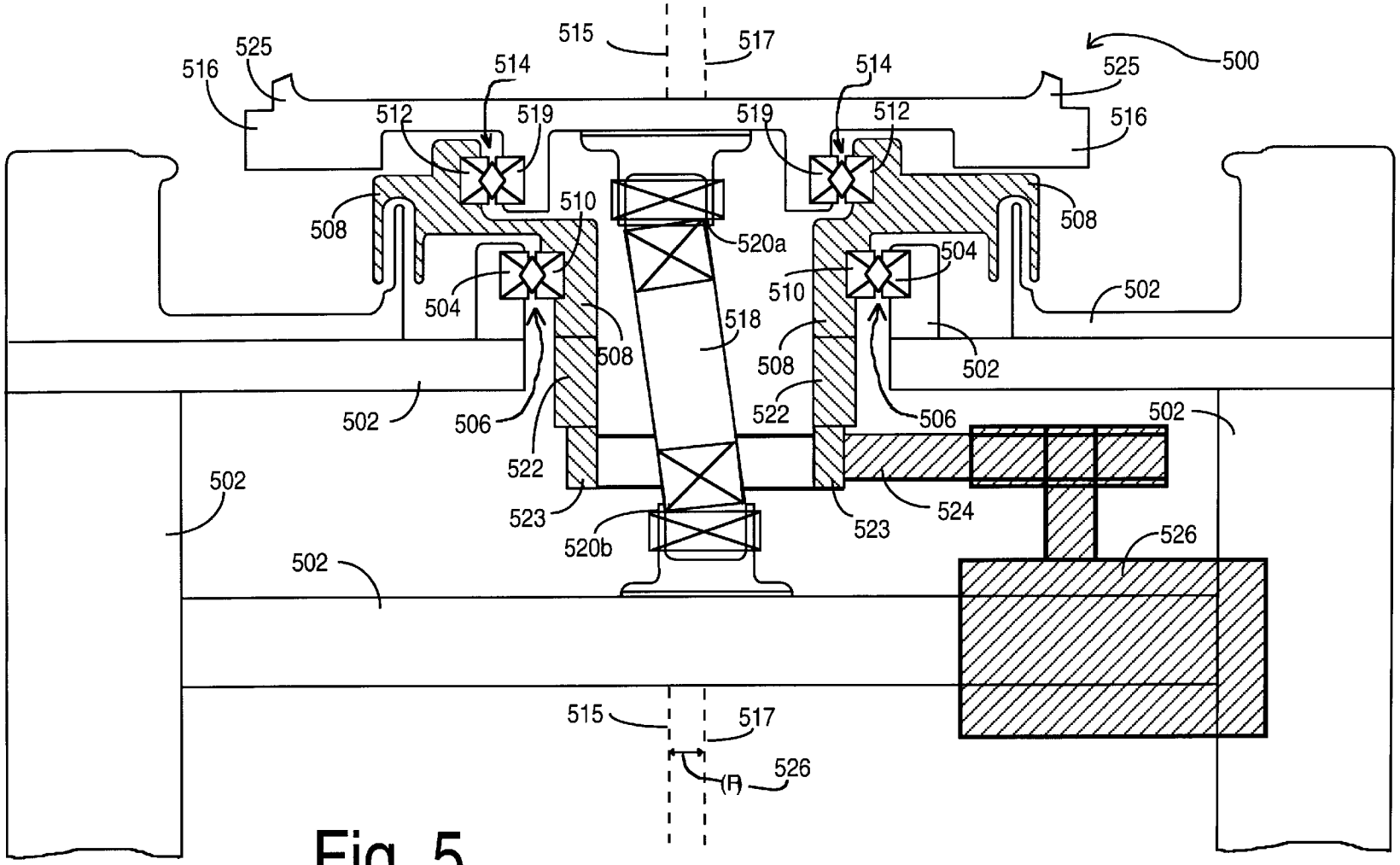
FIG. 5 is a cross-sectional view of an apparatus which can be used to generate the orbital motion for the polishing pad of the present invention.

FIG. 5 is a cross-sectional view of an apparatus which can be used to generate the orbital motion for the polishing pad. Orbital motion generator 500 has a rigid body or frame 502 which can be securely fixed to ground. Stationary frame 502 is used to support and balance motion generator 500. The outside ring 504 of a lower bearing 506 is rigidly fixed by clamps to stationary frame 502. Stationary frame 502 prevents inside ring 504 of lower bearing 506 from rotating. Wave generator 508 formed of a circular, hollow rigid stainless steel body is clamped to the inside ring 510 of lower bearing 506. Wave generator 508 is also clamped to outside ring 512 of an upper bearing 514. Wave generator 508 positions upper bearing 514 parallel to lower bearing 516. Wave generator 508 offsets the center axis 515 of upper bearing 514 from the center axis 517 of lower bearing 506. A circular aluminum table 516 is symmetrically positioned and securely fastened to the inner ring 519 of upper bearing 514. A polishing pad or pad assembly can be securely fastened to ridge 525 formed around the outside edge of the upper surface of table 516. A universal joint 518 having two pivoting points 520*a* and 520*b* is securely fastened to stationary frame 502 and to the bottom surface of table 516. The lower portion of wave generator 508 is rigidly connected to a hollow and cylindrical drive spool 522 which in turn is connected to a hollow and cylindrical drive pulley 523. Drive pulley 523 is coupled by a belt 524 to a motor 526. Motor 526 can be a variable speed, three phase, two horsepower A.C. motor.

The orbital motion of table 516 is generated by spinning wave generator 508. Wave generator 508 is rotated by variable speed motor 526. As wave generator 508 rotates, the center axis 515 of upper bearing 514 orbits about the center axis 517 of lower bearing 506. The radius of the orbit of the upper bearing 517 is equal to the offset (R) 526 between the center axis 515 of upper bearing 514 and the center axis 517 of lower bearing 506. Upper bearing 514 orbits about the center axis 517 of lower bearing 506 at a rate equal to the rotation rate of wave generator 508. It is to be noted that the outer ring 512 of upper bearing 514 not only orbits but also rotates (spins) as wave generator 508 rotates. The function of universal joint 518 is to prevent torque from rotating or spinning table 516. The dual pivot points 520*a* and 520*b* of universal joint 518 allow pad 516 to move in all directions except a rotational direction. By connecting table 516 to the inner ring 519 of upper bearing 512 and by connecting universal joint 518 to table 516 and stationary frame 502 the rotational movement of inner ring 519 and table 516 is prevented and table 516 only orbits as desired. The orbit rate of table 516 is equal to the rotation rate of wave generator 508 and the orbit radius of table 516 is equal to the offset of the center 515 of upper bearing 514 from the center 517 of lower bearing 506. It is to be appreciated that a variety of other well-known means may be employed to facilitate the orbital motion of the polishing pad in the present invention.

Another important feature of the present invention is the slurry delivery process. In the present invention, as shown in FIG. 3*a* and 3*b*, slurry is deposited onto the polishing pad surface by feeding slurry through a plurality of equally spaced apart holes 322 formed through the polishing pad. The holes are of sufficient size and spacing density to uniformly distribute slurry across the surface of the wafer being polished. Holes approximately 1/32 inch in diameter and uniformly spaced apart by approximately 1 inch have been found to provide good slurry delivery. By passing slurry through equally spaced holes in polish pad 602, slurry distribution across the surface of a wafer is uniform, which helps to create a uniform polish rate. Additionally, with such a technique slurry is delivered directly and immediately to the polish pad/wafer interface. This allows fast and controllable transitions between different slurry types and combinations of fluids. Additionally, by feeding slurry directly to the pad/wafer interface slurry is never exposed to air prior to polishing and is therefore unable to degrade before use. In the present invention slurry delivery is fast, predictable, and uniform, which helps make the present technique very manufacturable.

Figure 6A:
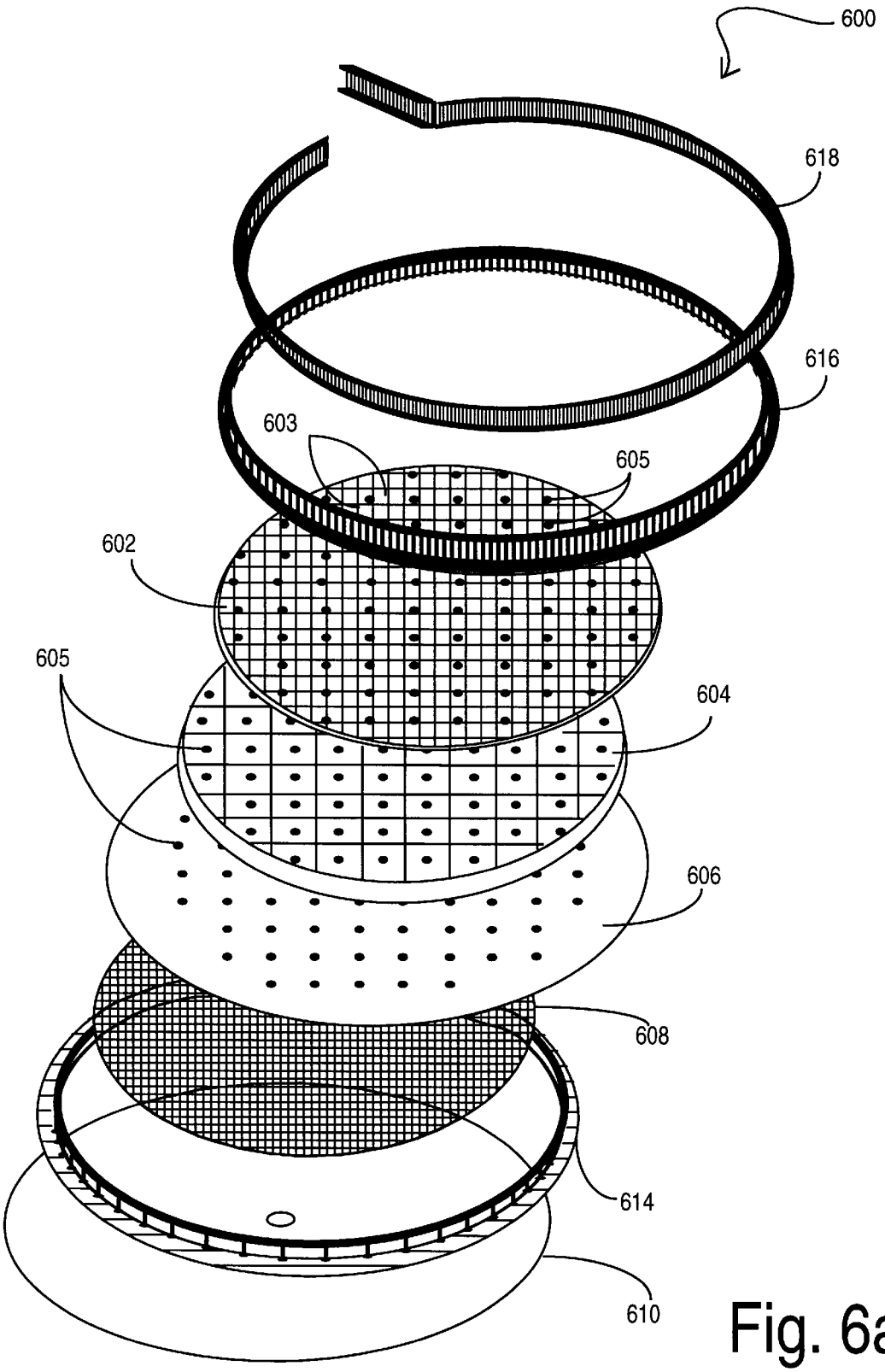
FIG. 6*a* is an exploded view of a pad assembly which can be used for attaching a polishing pad to a table and for uniformly distributing a slurry onto the pad surface during polishing.

FIG. 6*a* is an exploded view of a pad assembly 600 which can be used to connect polishing pad 602 to an orbiting table 620 and which can be used to feed slurry through polishing pad 602. It is to be appreciated, however, that pad assembly 600 is not essential to obtain good results from orbital polishing. Other pad assemblies, such as a pad attached to a rigid table (as in the prior art), can be used and good results obtained. The use of a pad assembly similar to assembly 600, however, is strongly recommended in order to obtain the best polishing results.

As shown in FIG. 6*a,* a polishing pad 602 is securely attached to a pad backing 604. Polishing pad 602 can have a plurality of horizontal and vertical grooves 603 formed in the surface of the pad to help facilitate slurry delivery. A plurality of through holes 605 are formed through polishing pad 602. Pad backing 604 can be made up of a urethane material broken up by deep cuts to achieve a desired flexibility/stiffness for pad 602. Pad backing 604 is securely attached to a thin stainless steel polishing diaphragm 606. Through holes 605 extend through pad backing 604 and stainless steel polishing diaphragm 606 so that slurry can flow from the underside of polishing diaphragm 606 to the top surface of polishing pad 602. A rubber slurry diaphragm 610 clamped beneath polishing diaphragm 606 is used to feed slurry through slurry through holes 605. A small hole is formed through the center of slurry diaphragm 610 so that slurry can be pumped onto the top surface of slurry diaphragm 610. A plastic meshing or screen 608 is placed between stainless steel polishing diaphragm 606 and rubber slurry diaphragm 610. Meshing 608 helps to uniformly distribute or spread slurry to individual slurry through holes 605 formed in polishing diaphragm 606. A combination of a lower V clamp ring 614, an upper V clamp ring 616, and a flexible V clamp 618 can be used to attach pad assembly 600 to a table.

Figure 6B:
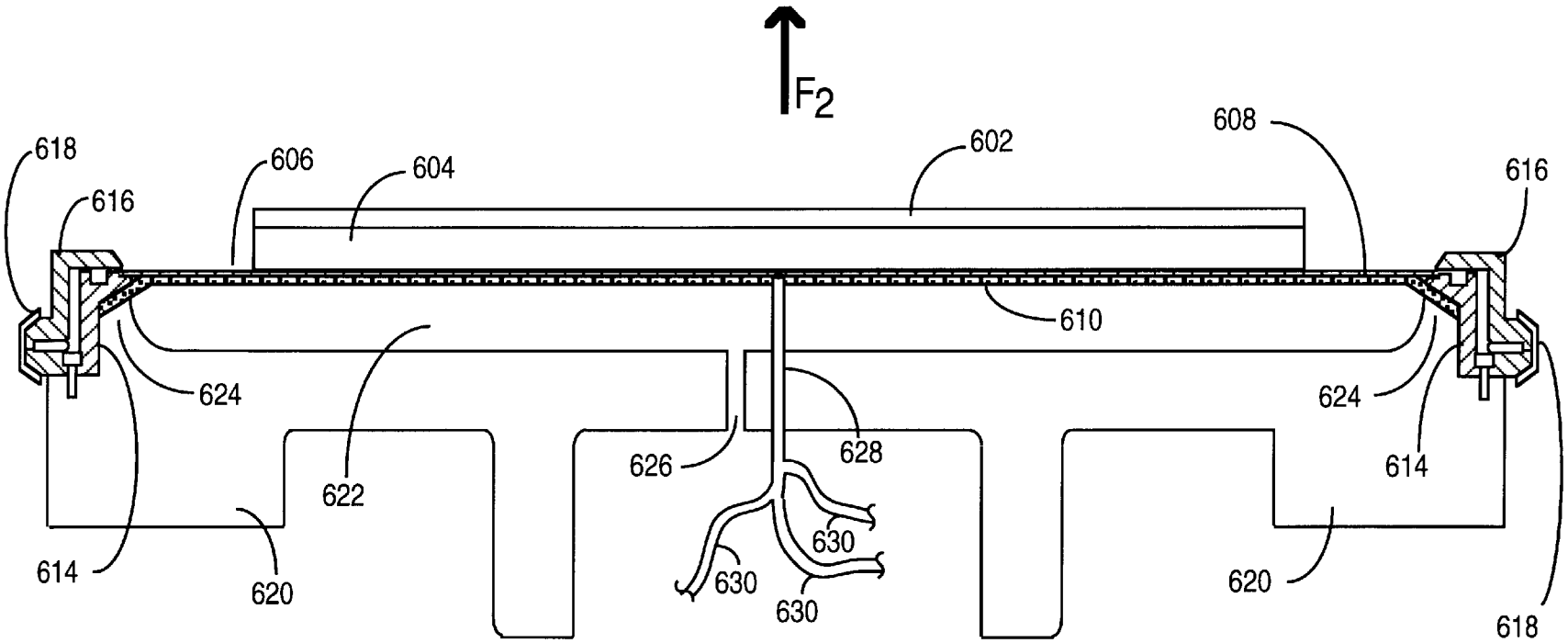
FIG. 6*b* is a cross-sectional view showing how the pad assembly of FIG. 6*a* can be attached to a table.

FIG. 6*b* is a cross-sectional view showing how pad assembly 600 can be connected to a table 620 and slurry delivery facilitated. The outside edge of rubber slurry diaphragm 610 is clamped with a tight seal between lower V clamp ring 614 and table 620. Lower V clamp ring 614 can be securely attached by screws to table 620. Stainless steel polish diaphragm 606 (with pad backing 604 and polish pad 602 attached to its outer surface) is symmetrically placed on the top surface of lower V clamp ring 614 and then clamped into place by upper V clamp ring 616 and universal flexible V band clamp 618. The V clamp assembly allows easy pad replacement and machine maintenance. It is to be appreciated that by attaching polishing diaphragm 606 to ridge 624 formed around the perimeter of table 620 a sealed pressure chamber or housing 622 is created between table 620 and polishing diaphragm 606. Rubber slurry diaphragm 610 is retained only on its outside edge so that it can deflect up and down in pressure chamber 622. Slurry diaphragm 610 rests against table 620 in the relaxed state and deflects up against meshing 608 and polish diaphragm 606 when air pressure is injected into chamber 622.

To deliver slurry to the top surface of pad 602 during polishing, slurry is pumped from a reservoir (not shown) onto the top surface of slurry diaphragm 610. A plurality of slurry delivery lines and deionized water lines 630 can be routed alongside the universal joint, up through the hollow drive pulley, dry spool, and wave generator to reach orbiting table 620. The slurry delivery lines 630 are coupled to a slurry feed 628, such as a hose, provided through table 620 and through the hole in slurry diaphragm 610 so that slurry can be continually deposited onto the top surface of slurry diaphragm 610. Plastic meshing 608 is used to uniformly distribute slurry about polishing diaphragm 606 and feed slurry through slurry through holes 605 formed in polishing diaphragm 606, pad backing 604, and polishing pad 602. Plastic meshing 608 allows uniform slurry delivery by preventing slurry diaphragm 610 from directly contacting polishing diaphragm 606 when air pressure is injected into chamber 622.

Air pressure from a variable pressure source, such as a compressor, can be forced through passage 626 into chamber 622 between orbiting table 620 and the bottom surface of slurry diaphragm 610. The air pressure developed in housing 622 provides a uniform upward pressure on polishing diaphragm 606, and hence polishing pad 602. This upward pad pressure $F_2$ can be used in conjunction with, or in place of, the downward pressure normally placed on a wafer to facilitate polishing. Air pressure can be adjusted to achieve the desired upward pressure. In the present invention an upward pad pressure which is matched to the downward wafer pressure (i.e., between 4–6 lbs/in$^2$) is used to help facilitate polishing.

Figure 7:
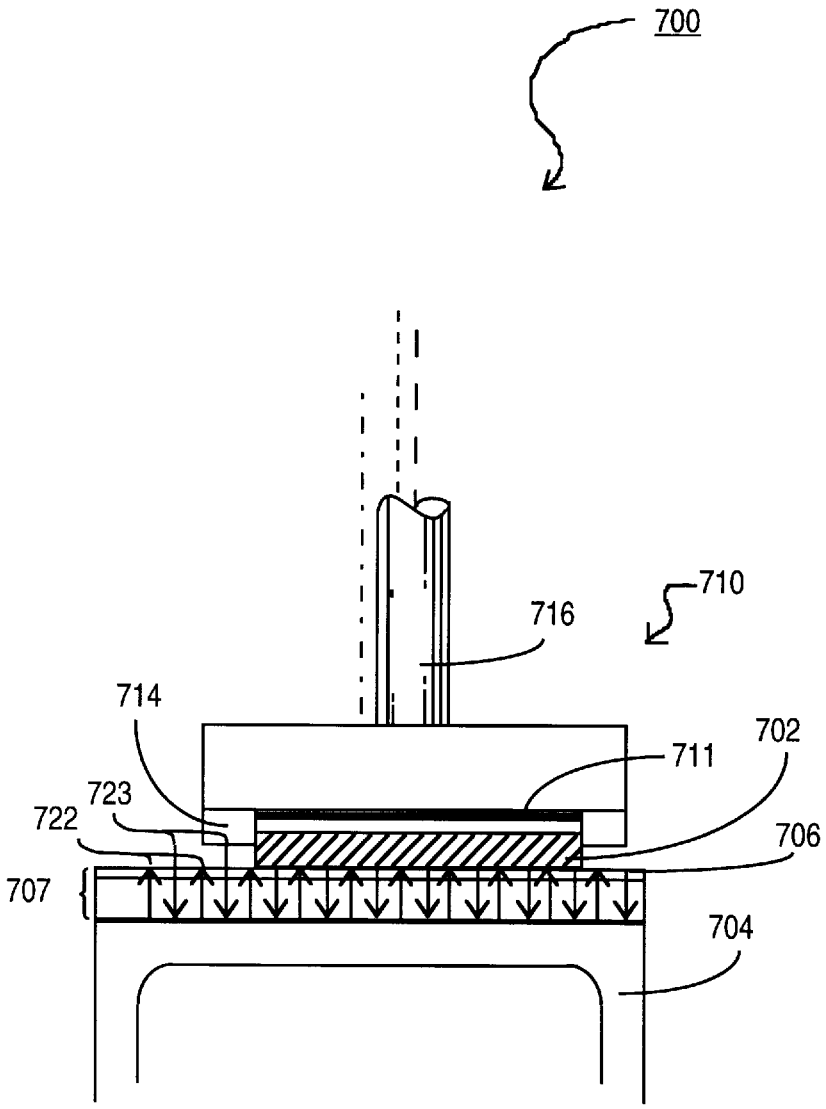
FIG. 7 is a cross-sectional view of an illustration of the chemical-mechanical polishing apparatus of another embodiment of the present invention.

With reference to FIG. 7, another embodiment of the present invention is shown wherein slurry is delivered to the polishing pad surface through a plurality of slurry delivery holes 722 and removed through slurry extraction holes 723 formed in polishing pad 706. It is appreciated that carrier 710, shaft 716, retaining ring 714, insert pad 711, table 704 and wafer 702 operate in accordance with their corresponding parts as previously described in the embodiment of FIG. 3*a.*

Figure 8A:
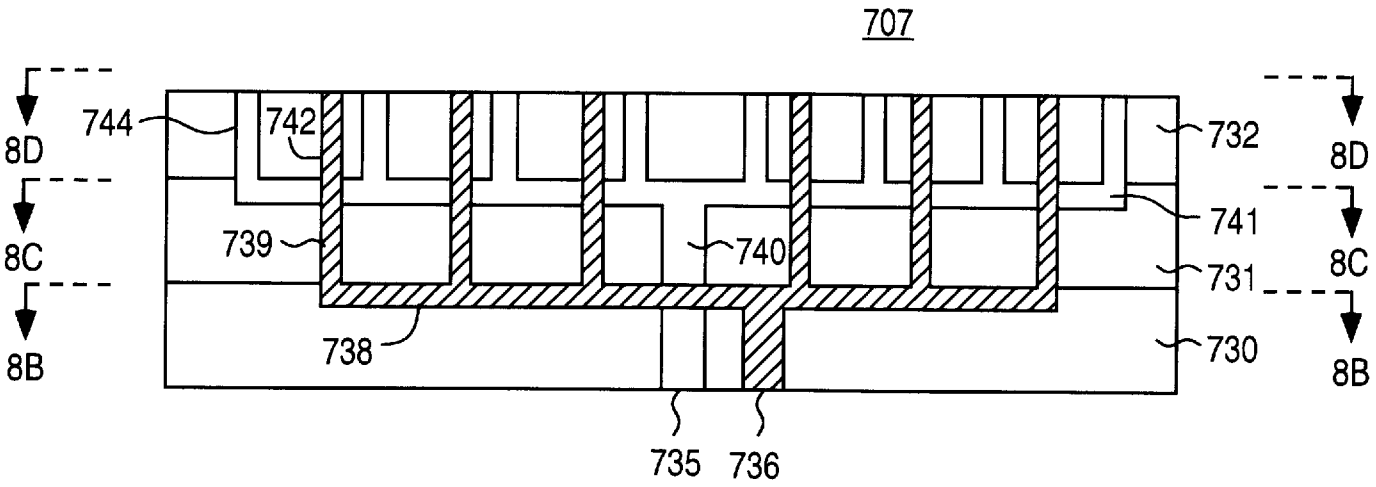
FIG. 8*a* is a cross-sectional view of the slurry delivery and removal assembly of FIG. 7.
Figure 8B:
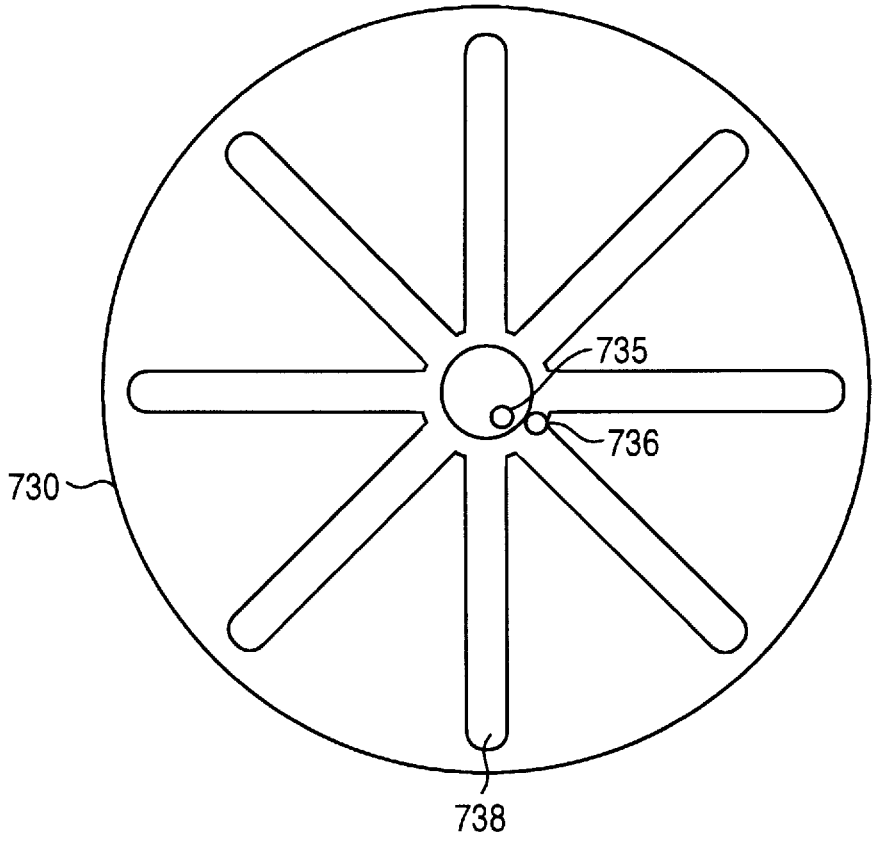
FIG. 8*b* illustrates a top view of the lower plate depicted in FIG. 8*a*.

FIG. 8*a* illustrates a detailed side view of the slurry delivery and removal assembly 707 depicted in FIG. 7. As illustrated, assembly 707 comprises three plates 730, 731 and 732. Combined, plates 730, 731 and 732 form a manifold system that facilitates the delivery and removal of slurry at the surface of polishing pad 706. Slurry is delivered from a slurry supply source and returned through slurry inlet and outlet holes 735 and 736 disposed within plate 730. Plate 730 also includes a return manifold 738 that connects the return holes 739 of plate 731 to outlet hole 736. FIG. 8*b* illustrates a top view of plate 730.

Figure 8C:
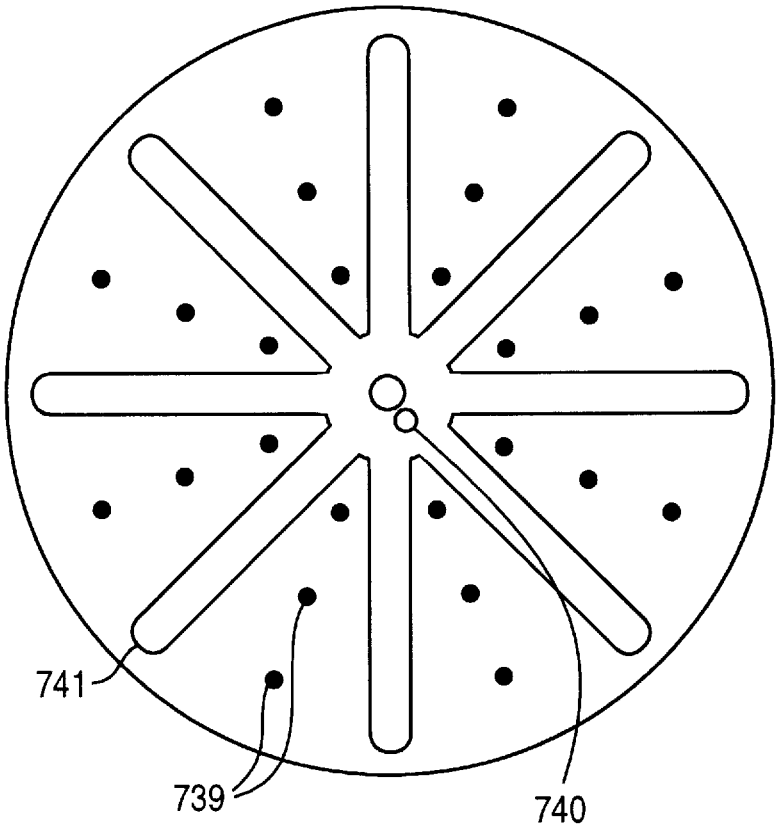
FIG. 8*c* illustrates a top view of the middle plate depicted in FIG. 8*a*.

Turning again to FIG. 8*a,* middle plate 731 is shown having through hole 740 connecting slurry inlet hole 735 of plate 730 to a supply manifold 741. Plate 731 also includes return holes 739 that connect return manifold 738 of plate 730 to the slurry collection ports 742 of plate 732. FIG. 8*c* illustrates a top view of plate 731.

Figure 8D:
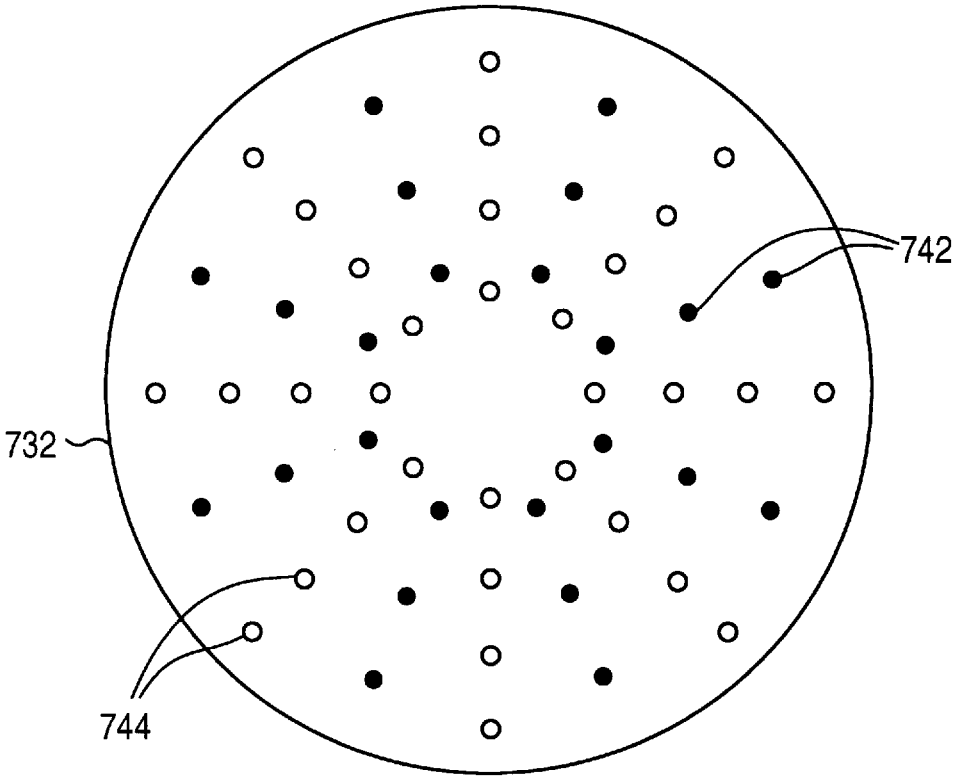
FIG. 8*d* illustrates a top view of the upper plate depicted in FIG. 8*a*.

With continuing reference to FIG. 8*a,* upper plate 732 is shown having slurry supply and collection ports 744 and 742, respectively. The position and spacing of supply and extraction ports 744 and 742 correspond to a hole pattern formed in polishing pad 706. FIG. 8*d* illustrates a top view of plate 732. The arrangement of supply and extraction ports can vary. It can range from a simple arrangement, wherein the slurry delivery ports are interspersed between the slurry extraction ports, to any of a number of complex schemes that optimize polishing uniformity. For example, if a given polisher design has a low polishing rate near the wafer edge, more delivery ports or larger diameter delivery ports can be positioned near the wafer edge. Another embodiment may include a plurality of delivery ports disposed within the inner diameter of plate 732 and a plurality of extraction ports positioned near the outer perimeter of plate 732.

Plates 730, 731 and 732 may be attached by any of a number of methods known in the art. By way of example, the plates may be bolted together by providing through holes along the outer edges of the plates. Other attachment means, such as, adhesives and clamps, may also be used. In addition, gaskets, o-rings, adhesives, etc. may be used to seal the interfaces between the plates.

Figure 9:
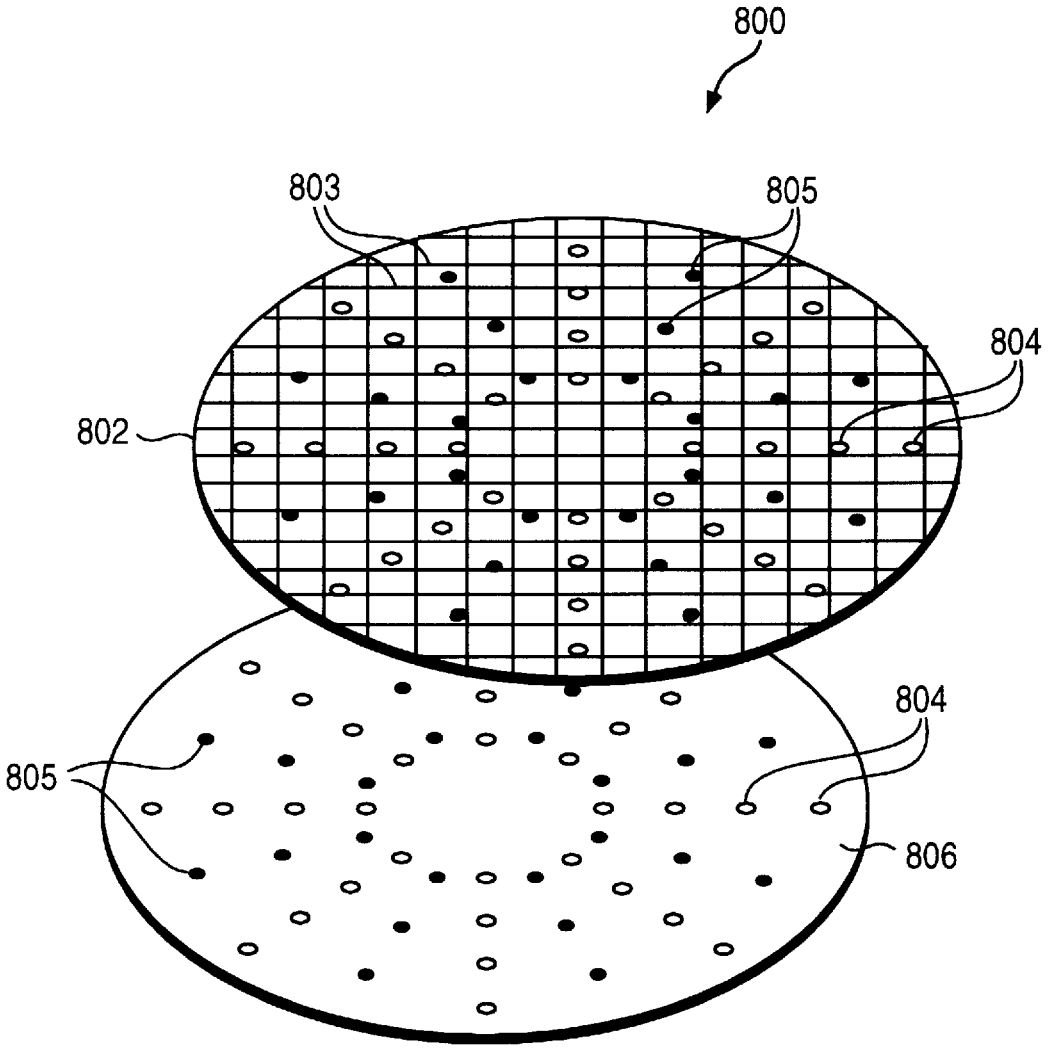
FIG. 9 is an exploded view of a pad assembly which can be used with the slurry delivery and removal assembly of FIG. 8*a*.

FIG. 9 illustrates an exploded view of a pad assembly 800 which can be used to connect polishing pad 802 to a slurry supply and return manifold 820 and which can be used to feed and remove slurry through polishing pad 802. As shown, pad assembly 800 comprises polishing pad 802 and polishing diaphragm 806. It is to be understood, however, that other pad assemblies may be used in lieu of pad assembly 800. For example, a single polishing pad without a polishing diaphragm may be used in the implementation of the present invention.

As shown in FIG. 9, polishing pad 802 is attached to a thin stainless steel polishing diaphragm 806. A plurality of through holes 804 and 805 are formed through polishing pad 802 that correspond with the supply and collection ports of manifold 820. Polishing pad 802 may have a plurality of horizontal and vertical grooves 803 formed in the surface of the pad to help facilitate the delivery and removal of slurry at the pad surface. It is important to note, however, that polishing pad 802 does not require grooves 803. Instead, the surface of pad 802 may be texturized in a manner that facilitates the transport of slurry between supply and collection holes 804 and 805. Note also, that holes 804 and 805 extend through polishing diaphragm 806 so that slurry can flow from the underside of polishing diaphragm 806 to the top surface of polishing pad 802.

Figure 10:
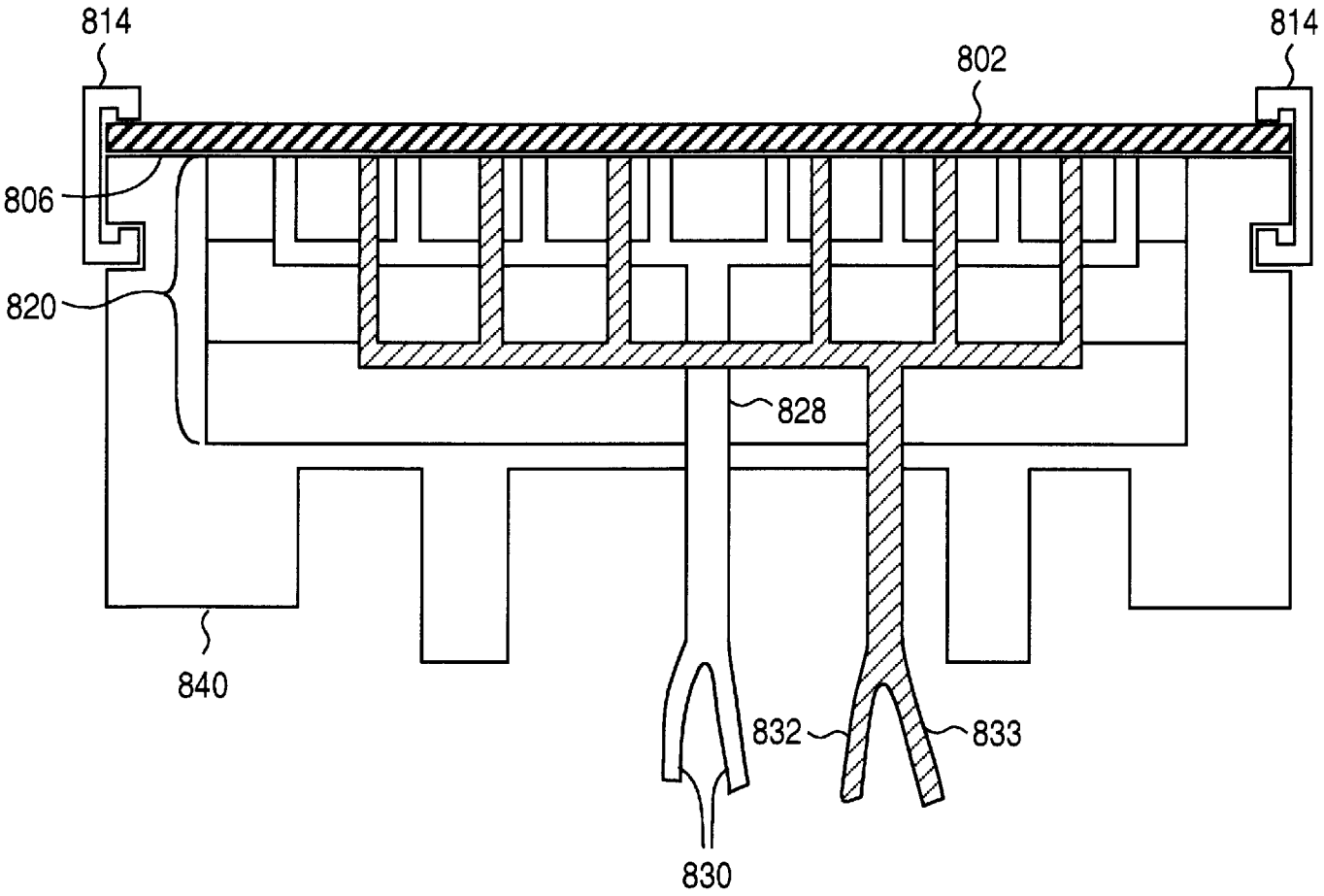
FIG. 10 is a cross-sectional view showing how the slurry delivery and removal assembly of FIG. 8*a* and polishing pad assembly of FIG. 9 can be attached to a table.

FIG. 10 is a cross-sectional view showing how manifold assembly 820 and polishing pad assembly 800 can be connected to a table 840. Table 840 may be fixed or may be attached to an orbital motion apparatus like that depicted in FIG. 5. As shown, manifold 820 fits within a recess formed within table 840. The outside edge of pad assembly 800 is positioned over manifold assembly 820 such that their corresponding slurry supply and collection holes are aligned. Pad assembly 800 is held in position by clamp ring 814. Although it is not shown, it is to be appreciated that a gasket or other sealing device may be positioned between diaphragm 806 and table 840 to form a seal around the perimeter of table 840.

To deliver slurry to the top surface of pad 802 during polishing, slurry is pumped from a reservoir (not shown). When employing the orbital motion apparatus of FIG. 5, a plurality of slurry delivery lines and deionized water lines 830 can be routed alongside the universal joint, up through the hollow drive pulley, dry spool, and wave generator to reach orbiting table 840. The slurry delivery lines 830 are coupled to manifold slurry inlet hole 828 so that slurry can be continually deposited onto the top surface of polishing pad 802. The slurry delivery lines typically comprises flexible hoses.

To remove slurry from the top surface of pad 802, a vacuum is drawn through either of lines 832 and 833. This creates a suction at the polishing pad extraction holes and subsequently draws slurry from the surface of polishing pad 802 through the return manifold of assembly 820 to either the slurry reservoir or some other slurry collection point.

In the foregoing description a manifold assembly has been described having both a delivery and return manifold wherein slurry is delivered and removed from the surface of a polishing pad through two separate manifolds. Note, however, that in some applications a single manifold may be used to both deliver and remove slurry at the surface of a polishing pad through the same set of through holes. This is accomplished by first pumping a designated amount of slurry from a reservoir to the surface of the polishing pad through a single manifold. At some later time, the slurry is removed from the surface of the polishing pad by drawing a vacuum on the same manifold.

There are a number of advantages associated with delivering and removing slurry through holes formed in the polishing pad surface. The type of slurry or liquid being delivered to the polishing pad surface can be changed quickly by simply switching to a different source line. As an example, a quick transition from polishing to rinsing with water can be accomplished in this manner. In addition, since slurry is locally collected on the pad near the delivery points, the time to make an effective transition from one liquid source to another is shortened. The ability to make quick transitions reduces transition time overhead from the total processing sequence, thus providing faster cycle times. The invention also allows a substantial reduction in the amount of slurry used within a given polishing step since most of the slurry is contained and collected through the polishing pad delivery and extraction holes. This is a major advantage since some slurries are expensive. Thus, the present invention allows processes requiring expensive slurries to be cost effective. In addition, since the slurry can be contained in a smaller volume, it can be more easily managed.

Although a carrier is not illustrated, it is understood that a carrier similar to that illustrated in FIG. 7 may be used when implementing the embodiment of FIG. 10. It is also appreciated that other carriers such as the improved carriers described in copending application Ser. No. 08/103,918, filed Aug. 6, 1993 and assigned to the present assignee, can also be utilized.

Figure 11:
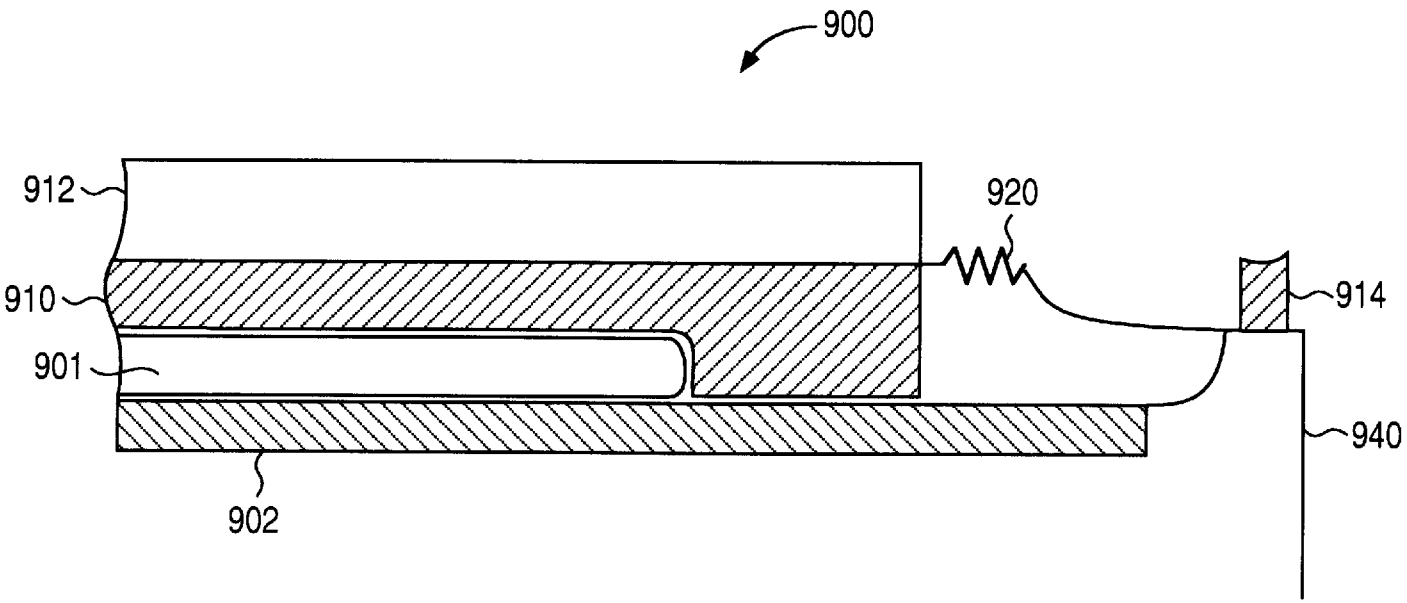
FIG. 11 is a cross-sectional view of a carrier assembly and bellows in one embodiment of the present invention.

FIG. 11 illustrates one carrier that may be used when implementing the embodiment illustrated in FIG. 10. As shown, carrier 900 comprises an upper section 912 and a lower section 910. Lower section 910 includes a recess for accommodating wafer 901. A downward force may be applied to the backside of wafer 901 by forcibly moving carrier assembly 900 toward polishing pad 902. In another embodiment, lower carrier section 910 may comprise a flexible material that forms the lower wall of a cavity located within upper section 912. Hence, when the upper section cavity is pressurized, lower section 910 deflects downward forcing wafer 901 against polishing pad 902.

With continuing reference to FIG. 11, a bellows 920 is shown disposed between carrier assembly 900 and table 940. Bellows 920 is provided to form a seal around the carrier during polishing operations. In this manner, wafer 901 may be processed in a closed and controlled environment. Bellows 920 may be attached to table 940 by using a clamp 914. It is appreciated, however, that any of a number of other attachment methods may also be used.

Novel chemical-mechanical polishing techniques have been described. The novel chemical-mechanical polishing techniques of the present invention help to create a uniform polishing environment across the surface of a wafer. A polishing pad is orbited at a radius less than the radius of the wafer to be polished in order to provide uniform pad movement across the surface of the wafer. Additionally, in one embodiment slurry is fed through the polishing pad to directly and uniformly provide slurry to the pad/wafer interface during polishing. In another embodiment, slurry is delivered to the polishing pad surface through a plurality of slurry delivery holes and removed through slurry extraction holes formed in the polishing pad. It is to be appreciated that a number of different techniques have been described in the present invention which help to create a uniform and manufacturable polishing process. It is to be appreciated, however, that the techniques described in the present invention can be used independently or in combination with other techniques to improve chemical-mechanical polishing uniformity without departing from the scope of the present invention. Additionally, it is to be appreciated that one may easily change parameters such as orbit rate, orbit radius, pad sizes, polish pressure, etc., in order to optimize the polishing process for a specific application without departing from the scope of the present invention.

Thus, novel chemical-mechanical polishing techniques for creating uniform polish rates have been described.

I claim:

1. A chemical-mechanical polishing apparatus for polishing a thin film formed on a semiconductor substrate having a first radius, said apparatus comprising:

a polishing pad having a plurality of spaced apart through holes;

means for orbiting said polishing pad about an axis, the orbit having a second radius, the second radius being less than the first radius;

means for delivering an abrasive slurry through said plurality of spaced apart through holes to the surface of said polishing pad; and means for removing said abrasive slurry from said surface of said polishing pad through said plurality of spaced apart through holes.

2. The chemical-mechanical polishing apparatus of claim 1 wherein said polishing pad has a plurality of preformed grooves, said preformed grooves facilitating uniform distribution of said abrasive slurry.

3. A chemical-mechanical polishing apparatus for polishing a thin film formed on a semiconductor substrate having a radius, said apparatus comprising:

a polishing pad having a first plurality of spaced apart through holes for delivering an abrasive slurry to the surface of said polishing pad and a second plurality of spaced apart through holes for removing said abrasive slurry from said surface of said polishing pad;

means for orbiting said polishing pad about an axis, wherein the radius of the orbit of said polishing pad about said axis is less then the radius of said substrate;

means for delivering said abrasive slurry through said first plurality of spaced apart through holes to the surface of said polishing pad; and means for removing said abrasive slurry from said surface of said polishing pad through said second plurality of spaced apart through holes.

4. The chemical-mechanical polishing apparatus of claim 3 wherein said polishing pad has a plurality of preformed grooves, said preformed grooves facilitating uniform distribution of said abrasive slurry.

5. The chemical-mechanical apparatus of claim 3 wherein said polishing pad is texturized to facilitate the transport of said abrasive slurry between said first and second plurality of through holes.

6. A chemical-mechanical polishing apparatus for polishing a thin film formed on a semiconductor substrate having a radius, said apparatus comprising:

a polishing pad having a first plurality of spaced apart through holes for delivering an abrasive slurry to the surface of said polishing pad and a second plurality of spaced apart through holes for removing said abrasive slurry from said surface of said polishing pad;

means for orbiting said polishing pad about an axis, wherein the radius of the orbit of said polishing pad about said axis is less then the radius of said substrate;

means for feeding an abrasive slurry through said first plurality of spaced apart through holes to the surface of said polishing pad;

means for removing said abrasive slurry from said surface of said polishing pad through said second plurality of spaced apart through holes; and a substrate carrier for forcibly pressing said substrate against said polishing pad, wherein the center of said substrate is offset from said axis.

7. The chemical-mechanical polishing apparatus of claim 6 wherein said polishing pad has a plurality of preformed grooves, said preformed grooves facilitating uniform distribution of said abrasive slurry.

8. The chemical-mechanical polishing apparatus of claim 6 wherein said polishing pad is texturized to facilitate the transport of said abrasive slurry between said first and second plurality of through holes.

9. An apparatus for polishing a thin film formed on a semiconductor substrate, said apparatus comprising:

a polishing pad having a plurality of spaced apart through holes;

a manifold for delivering and removing an abrasive slurry through said through holes of said polishing pad;

means for providing movement between said polishing pad and said semiconductor substrate; and a substrate carrier for forcibly pressing said substrate against said polishing pad.

10. The apparatus of claim 9 wherein said polishing pad has a plurality of preformed grooves, said preformed grooves facilitating uniform distribution of said abrasive slurry.

11. The apparatus of claim 9 wherein said substrate carrier rotates said substrate against said polishing pad during polishing.

12. An apparatus for polishing a thin film formed on a semiconductor substrate, said apparatus comprising:

a polishing pad having a first plurality of spaced apart through holes for delivering an abrasive slurry to the surface of said polishing pad and a second plurality of spaced apart through holes for removing said abrasive slurry from said surface of said polishing pad;

a first manifold for delivering said abrasive slurry through said first plurality of through holes to the surface of said polishing pad;

a second manifold for removing said abrasive slurry through said second plurality of through holes from the surface of said polishing pad;

means for providing movement between said polishing pad and said semiconductor substrate; and a substrate carrier for forcibly pressing said substrate against said polishing pad.

13. The apparatus of claim 12 wherein said polishing pad is texturized to facilitate the transport of said abrasive slurry between said first and second plurality of through holes.

14. The apparatus of claim 12 wherein said polishing pad has a plurality of preformed grooves, said preformed grooves facilitating uniform distribution of said abrasive slurry.

15. The apparatus of claim 12 wherein said substrate carrier rotates said substrate against said polishing pad during polishing.

16. A method for polishing a thin film formed on a semiconductor substrate having a radius, said method comprising the steps of:

(a) delivering a slurry to the surface of a polishing pad through a plurality of through holes formed in said polishing pad;

(b) forcibly pressing said substrate against said polishing pad;

(c) providing movement between said polishing pad and said substrate; and (d) suctioning said slurry from the surface of said polishing pad through said plurality of through holes.

17. The method of claim 16 wherein the step of providing movement between said polishing pad and said substrate includes orbiting said polishing pad about an axis, wherein the radius of the orbit of said polishing pad about said axis is less than the radius of said substrate.

18. A method for polishing a thin film formed on a semiconductor substrate having a radius, said method comprising the steps of:

(a) delivering a slurry to the surface of a polishing pad through a first plurality of through holes formed in said polishing pad;

(b) forcibly pressing said substrate against said polishing pad;

(c) providing movement between said polishing pad and said substrate; and (d) suctioning said slurry from the surface of said polishing pad through a second plurality of through holes formed in said polishing pad.

19. The method of claim 18 wherein the step of providing movement between said polishing pad and said substrate includes orbiting said polishing pad about an axis, wherein the radius of the orbit of said polishing pad about said axis is less than the radius of said substrate.

* * * * *